US006466120B1

(12) United States Patent
Tokuda et al.

(10) Patent No.: US 6,466,120 B1
(45) Date of Patent: Oct. 15, 2002

(54) LAMINATED INDUCTOR AND METHOD OF PRODUCING THE SAME

(75) Inventors: Hiromichi Tokuda; Tsuyoshi Tatsukawa, both of Takefu (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/679,155

(22) Filed: Oct. 5, 2000

(30) Foreign Application Priority Data

Oct. 5, 1999 (JP) ..... 11-284331

(51) Int. Cl.[7] ..... H01F 27/02
(52) U.S. Cl. ..... 336/83; 336/200; 336/192
(58) Field of Search ..... 336/65, 83, 200, 336/223, 192, 188, 208; 257/531

(56) References Cited

U.S. PATENT DOCUMENTS 5,849,355 A * 12/1998 McHenry ..... 427/79
5,888,662 A * 3/1999 Person et al. ..... 336/200
5,977,850 A * 11/1999 Chaturvedi ..... 333/238
6,008,151 A * 12/1999 Sasaki et al. ..... 501/17
6,120,884 A * 9/2000 Igarashi et al. ..... 428/209
6,215,387 B1 * 4/2001 Person et al. ..... 336/200

* cited by examiner

*Primary Examiner*—Lincoln Donovan
*Assistant Examiner*—Tuyen T. Nguyen
(74) *Attorney, Agent, or Firm*—Keating & Bennett, LLP

(57) ABSTRACT

A laminated inductor includes a sintered ceramic body made of a ceramic material and a coil conductor disposed inside of the ceramic body. The coil conductor has a plurality of conductor patterns and via-hole electrodes electrically connecting the conductor patterns which are located at different vertical positions in the ceramic body. A low dielectric constant material layer having a lower dielectric constant than that of the ceramic material of the sintered ceramic body is interposed between adjacent conductor patterns.

9 Claims, 8 Drawing Sheets

LAMINATED INDUCTOR AND METHOD OF PRODUCING THE SAME

BACKGROUND OF THE INVENTION

1. Field of the Invention

The present invention relates to a laminated inductor constructed using a laminated ceramic integral firing technique, and a method of producing the same, and more particularly, to a laminated inductor in which a low dielectric constant material layer is arranged between conductor patterns defining a coil conductor, and a method of producing the same.

2. Description of the Related Art Conventionally, laminated inductors using magnetic ceramics have been widely used. FIGS. 8 and 9 are a cross-sectional view and a perspective view, respectively, showing a conventional laminated inductor.

A laminated inductor 51 includes a sintered ceramic body 52 made of a magnetic ceramic material. A coil conductor 53 is embedded inside of the sintered ceramic body 52. The coil conductor 53 defines a spiral winding circuit inside of the sintered ceramic body 52. One end portion 53*a* extends to an end surface 52*a*, while the other end portion 53*b* extends to an end surface 52*b*. Terminal electrodes 54 and 55 are arranged to cover the ends surfaces 52*a* and 52*b*, respectively. Thus, the coil conductor 53 is connected to the terminal electrodes 54 and 55.

In order to manufacture the above-described sintered ceramic body 52, conductor patterns constituting a coil pattern are printed on magnetic green sheets, respectively. A plurality of magnetic green sheets each having a conductor pattern printed thereon are laminated, and then magnetic green sheets having no conductor patterns thereon are laminated on the upper side and the lower side of the laminated magnetic green sheets to define a laminated body. The laminated body is then fired so as to produce the sintered ceramic body 52. Thus, the sintered ceramic body 52 is formed by the well-known laminated ceramic integral firing technique.

Examples of the above-described conductor patterns will be described with reference to FIG. 9. FIG. 9 shows the uppermost conductor pattern 53*c* of the coil conductor 53 and the lower conductor pattern 53*d*. The conductor pattern 53*c* is printed on a magnetic green sheet 56. The end portion 53*a* of the conductor pattern 53*c* extends to one-side edge 56*a* of the magnetic green sheet 56. Further, a via-hole electrode 57 is located near the inner-side end portion of the conductor pattern 53*c*.

A conductor pattern 53*d* is located on the upper side of a magnetic green sheet 58. The vicinity of one end portion $\mathbf{53}d_1$ of the conductor pattern 53*d* is arranged so as to overlap with the via-hole electrode 57. That is, when the magnetic green sheets 56 and 58 are laminated, the conductor patterns 53*c* and 53*d* are electrically connected to each other through the via-hole electrode 57. A via-hole electrode 59 is formed in the vicinity of the other end of the conductor pattern 53*d*. The via-hole electrode 59 is electrically connected to a conductor pattern positioned below the conductor pattern 53*d*. In this manner, a plurality of conductor patterns are laminated through magnetic green sheets, respectively, to define the above-described coil conductor 53.

The laminated inductor 51 is produced by using the laminated ceramic integral firing technique. Accordingly, the control of the number of turns of the coil conductor 53 can be easily performed, and moreover, a small-sized inductance component can be formed.

However, since the conductor patterns at different heights or vertical positions in the coil conductor 53 overlap through magnetic ceramic layers, the generation of stray capacitances between the conductor patterns at the different vertical positions can not be prevented. For this reason, in the laminated inductor 51, the noise-removing characteristics are reduced, due to the effects of the above-described stray capacitances.

SUMMARY OF THE INVENTION

In order to overcome the problems described above, preferred embodiments of the present invention provide a laminated inductor in which stray capacitances between conductor patterns located at different vertical positions are minimized, and thereby, the noise-removing characteristic is greatly improved.

According to a preferred embodiment of the present invention, a laminated inductor includes a sintered ceramic body, and a coil conductor disposed inside of the sintered ceramic body which includes a sintered ceramic body made of a ceramic, a coil conductor disposed inside of the sintered ceramic body and including two ends which extend to the outer surface of the sintered ceramic body, first and second external electrodes located on the areas to which the coil conductor of the sintered ceramic body extend, respectively, the coil conductor including a plurality of conductor patterns located at different vertical positions in the sintered ceramic body, and a via-hole electrode through which conductor patterns, which are vertically adjacent to each other in the sintered ceramic body, are connected to each other, and low dielectric constant material layers laminated to both sides in the thickness direction of at least one of the plurality of conductor patterns, the low dielectric constant material having a lower dielectric constant than that of the ceramic constituting the sintered ceramic body.

Preferably, a first ring-path corresponding to one turn of the coil conductor is located in a height range where the conductor pattern is located. The first ring-path is defined by the conductor pattern and a low dielectric constant material layer. Also, a second ring-path corresponding to one turn of the coil conductor is defined by the via-hole electrode and a low dielectric constant material layer, and is located in the height range where a via-hole electrode is located.

Moreover, according to another preferred embodiment of the present invention, there is provided a method of producing a laminated inductor in which a coil conductor is located inside of a sintered ceramic body made of a ceramic material. The method includes the steps of preparing a first composite sheet having a conductor pattern defining a portion of the coil conductor and a low dielectric constant material pattern connected to the conductor pattern located on a support film, the conductor pattern and the low dielectric constant material pattern defining a ring-path corresponding to one turn of the conductor pattern, and a ceramic green layer provided on the support film excluding the area where the conductor pattern and the low dielectric constant material pattern are formed, preparing a second composite sheet including a via-hole electrode, a low dielectric constant material pattern formed so as to define together with the via-hole electrode a ring-path corresponding to one turn of the coil conductor, and a ceramic green layer provided on a support film excluding the area where the via-hole electrode and the low dielectric constant material pattern are formed, laminating the first and second composite sheets to each other with the support film between the composite sheets being released in such a manner that the conductor pattern of the first composite sheet overlaps the via-hole electrode of the second composite sheet, repeating the above-described lamination step to produce a laminate body in which a coil conductor including the plurality of conductor patterns and the via-hole electrode, and both ends of the coil conductor are exposed to the outer surface of the laminate body, firing the laminate body to produce a sintered ceramic body, and forming first and second external electrodes to be electrically connected to both ends of the coil conductor on the outer surface of the sintered ceramic body.

Preferably, in the method of producing a laminated inductor according to a preferred embodiment of the present invention, the conductor pattern is formed so as to have 1/n times the length of the ring-path, and in the step of laminating the plurality of first composite sheets through the second composite sheets, respectively, a first composite sheet at an upper position is rotated by about 360° n relative to the center of the ring-path with respect to the next lower first composite sheet and then the first composite sheet is laminated on the next lower first composite sheet.

More preferably, in the method of manufacturing a laminated inductor according to a preferred embodiment of the present invention, the first and second composite sheets have a substantially rectangular plan shape, respectively, the conductor pattern constitutes about half the length of the ring-path, and in the step of laminating the plurality of first composite sheets through the second composite sheets, respectively, an upper first composite sheet is rotated by about 1800 relative to the center of the ring-path with respect to the next lower first composite sheet and then the upper first composite sheet is laminated on the next lower first composite sheet.

Other features, elements, characteristics and advantages of the present invention will become more apparent from detailed description of the preferred embodiments below.

DETAILED DESCRIPTION OF PREFERRED EMBODIMENTS

Figure 1:
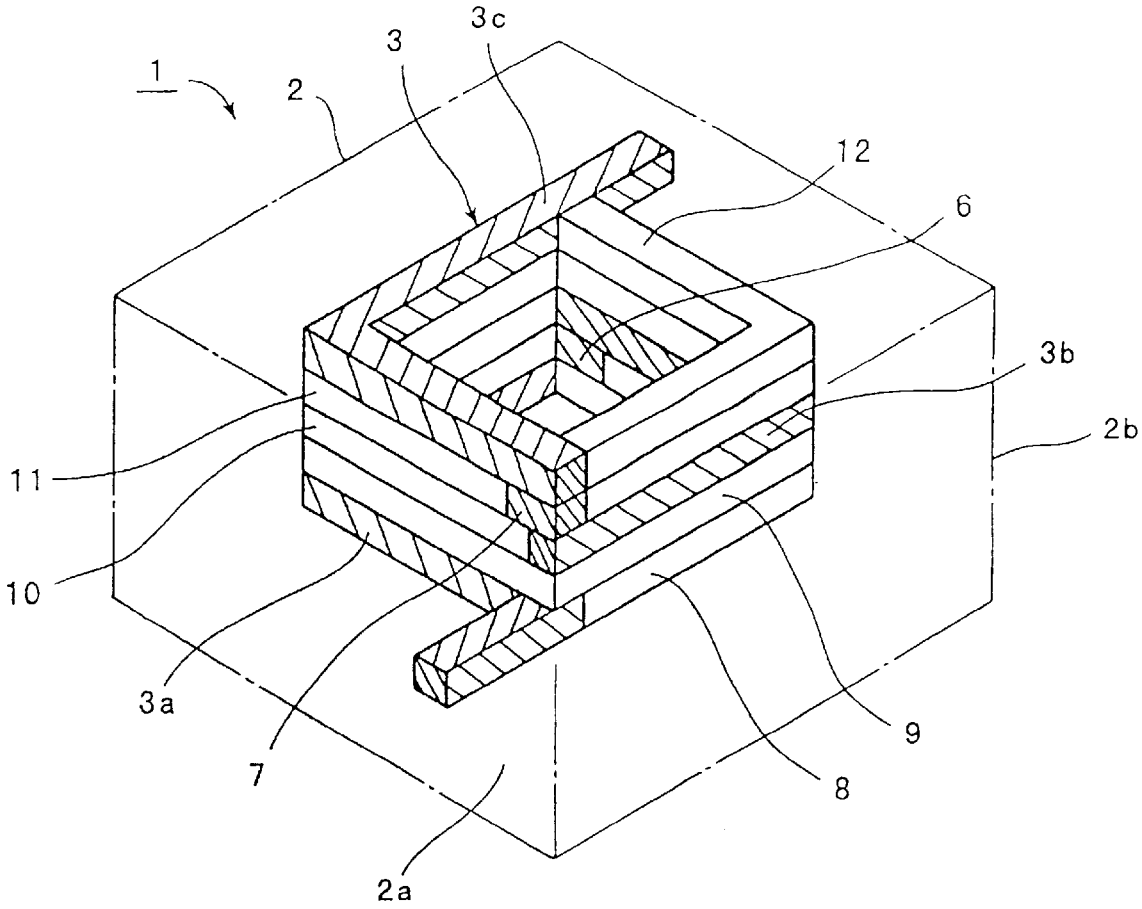
FIG. 1 is a schematic perspective view showing a laminated inductor according to a preferred embodiment of the present invention.
Figure 2:
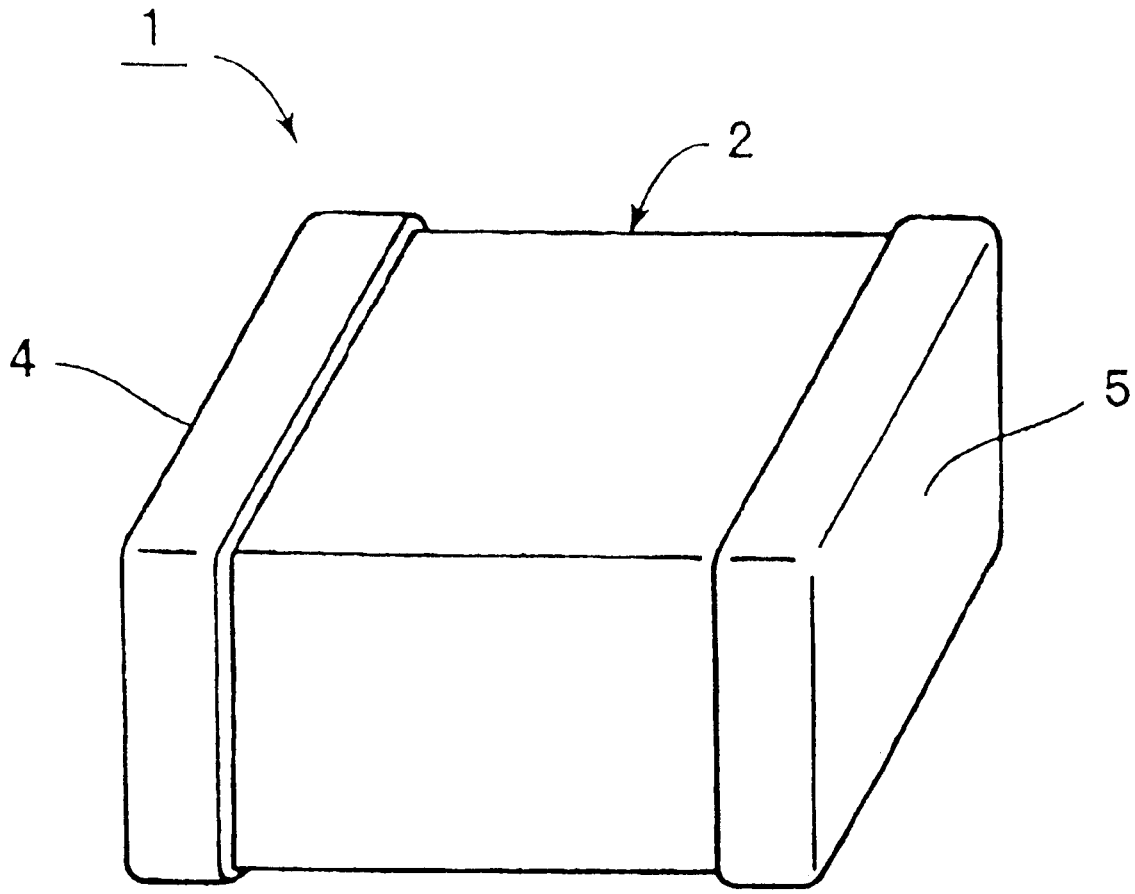
FIG. 2 is a perspective view showing a laminated inductor according to another preferred embodiment of the present invention.

FIG. 1 is a schematic perspective view showing a laminated inductor according to a preferred embodiment of the present invention. FIG. 2 is a perspective view showing the appearance of the laminated inductor. As shown in FIG. 1, a coil conductor 3 is arranged in a sintered ceramic body 2 depicted by the imaginary line. The sintered ceramic body 2 is made of a magnetic ceramic material such as ferrite or other suitable material. In this preferred embodiment, the sintered ceramic body has a substantially rectangular plate shape. The shape of the sintered ceramic body 2 is not limited to the substantially rectangular plate shape, and may have a substantially rectangular parallelpiped shape, a substantially cube shape, or a substantially polygonal plate shape. The sintered ceramic body 2 may be formed from a dielectric ceramic or an insulation ceramic, in addition to the magnetic ceramic.

As shown in FIG. 2, first and second external electrodes 4 and 5 are arranged so as to cover a pair of the end surfaces 2*a* and 2*b* (see FIG. 1) of the sintered ceramic body 2. The external electrodes 4 and 5 are formed by applying an electro-conductive material such as Ag, Cu, or other suitable material by a method such as electro-conductive paste coating and baking, vapor deposition, plating or sputtering.

The laminated inductor 1 of this preferred embodiment has a low dielectric constant material layer with a dielectric constant lower than that of the ceramic constituting the sintered ceramic body 2. The low dielectric constant material layer is laminated to a conductor pattern, described later, of the coil conductor 3.

That is, as seen in FIG. 1, the coil conductor 3 includes a plurality of conductor patterns 3*a*, 3*b*, and 3*c* which are electrically connected to each other through via-hole electrodes 6 and 7. Further, in the sintered ceramic body 2, low dielectric constant material layers 8 to 12 are provided. At least one side of each of the conductor patterns 3*a*, 3*b*, and 3*c* in the thickness direction of the sintered ceramic body, the low dielectric constant material layers 9 and 11 are laminated, respectively, whereby the stray capacitances between the conductor patterns at different heights are minimized. This will be made apparent by describing the method of producing a laminated inductor of this preferred embodiment with reference to FIGS. 3 to 7.

Figure 3A:
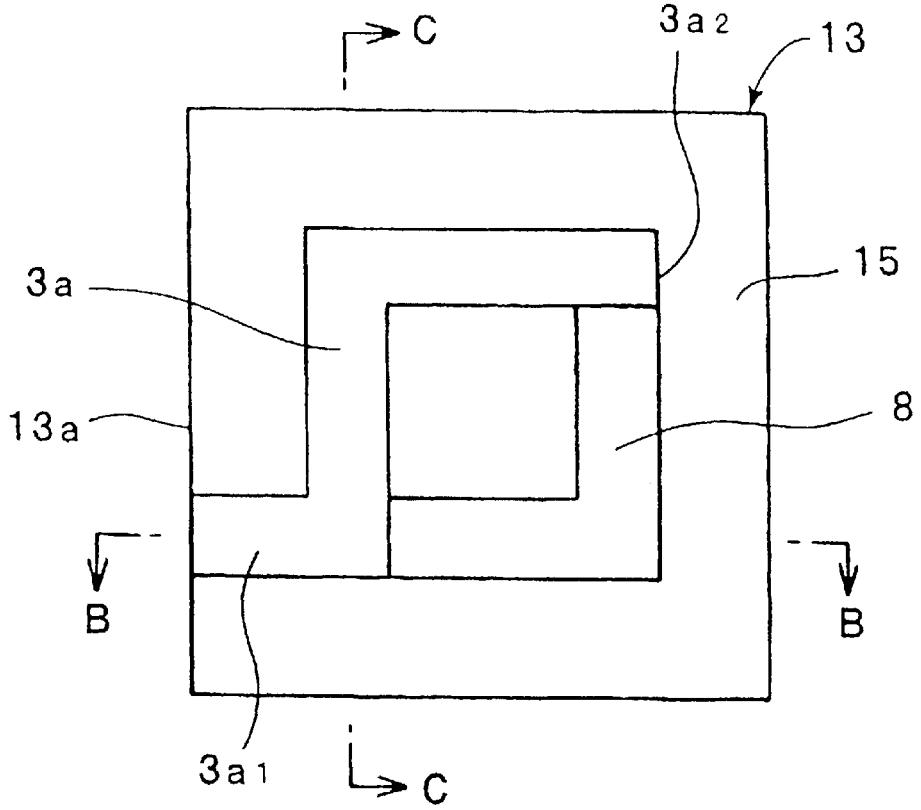
FIG. 3A is a plan view of a first composite sheet.

In order to produce the laminated inductor 1, first, a first composite sheet 13 shown in FIG. 3A is prepared. The first composite sheet 13 is produced by forming the conductor pattern 3*a*, the low dielectric constant material layer 8, and a magnetic green layer 15 on a support film 14 made of synthetic resin such as polyethyleneterephthalate (hereinafter, referred to as PET, briefly).

The conductor pattern 3*a* is formed by printing electro-conductive paste containing Ag, Ag—Pd, Cu, Ni, or other suitable material. The conductor pattern 3*a* has a shape and size corresponding to half of one turn of the substantially rectangular winding circuit(a coil portion). The conductor pattern 3*a*, positioned as the lowermost layer of the coil conductor 3, has a lead portion 3*a*1. The lead portion 3*a*1 extends to the one-side edge 13*a* of the composite sheet 13.

The low dielectric constant material layer 8 is preferably made of a material, e.g., glass, having a lower dielectric constant than the magnetic ceramic constituting the sintered ceramic body 2. The low dielectric constant material layer 8 is preferably formed by printing the above-mentioned dielectric ceramic paste in a substantially L-shaped pattern. The low dielectric constant material layer 8 and the conductor pattern 3*a* excluding the lead portion 3*a*1 define a substantially rectangular ring-path which corresponds to the winding circuit, that is, the coil conductor 3 viewed in the plan thereof in the laminated inductor 1 of this preferred embodiment.

On the side of the support film 14 excluding the area where the above-described conductor pattern 3 and the low dielectric constant material layer 8 are formed, the magnetic green layer 15 is formed.

Figure 3B:
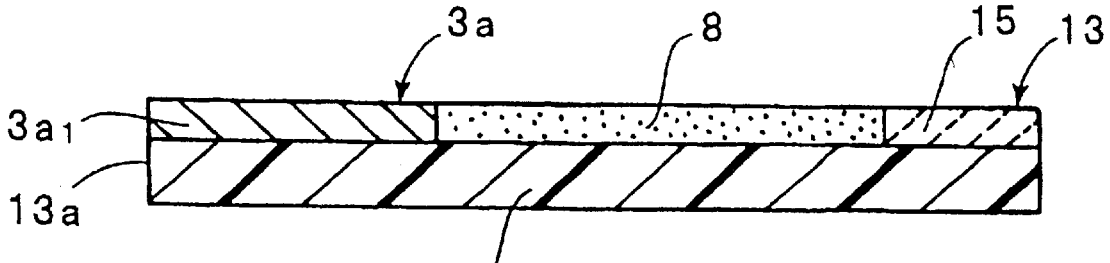
FIG. 3B is a cross-sectional view taken along line B—B of FIG. 3A.
Figure 3C:
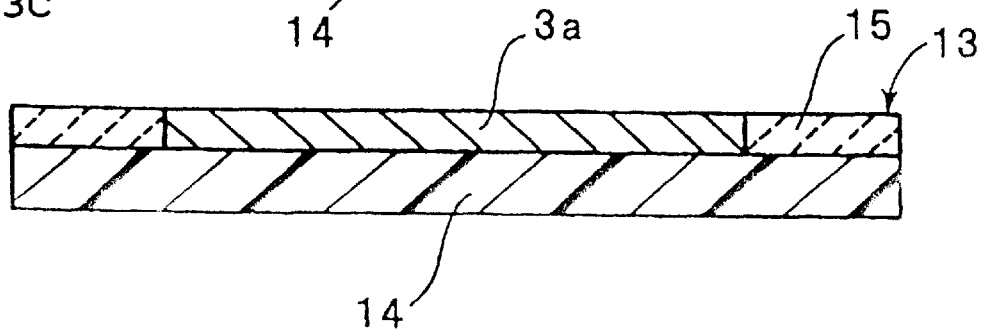
FIG. 3C is a cross-sectional view taken along line E—E of FIG. 3A.

As seen in FIGS. 3B and 3C, the conductor pattern 3*a* and the magnetic green layer 15 preferably have a substantially equal thickness. Further, in FIGS. 3A, 3B, and 3C, the thickness of the low dielectric constant material layer 8 is preferably substantially equal to those of the conductor pattern 3*a* and the magnetic green layer 15.

Figure 4A:
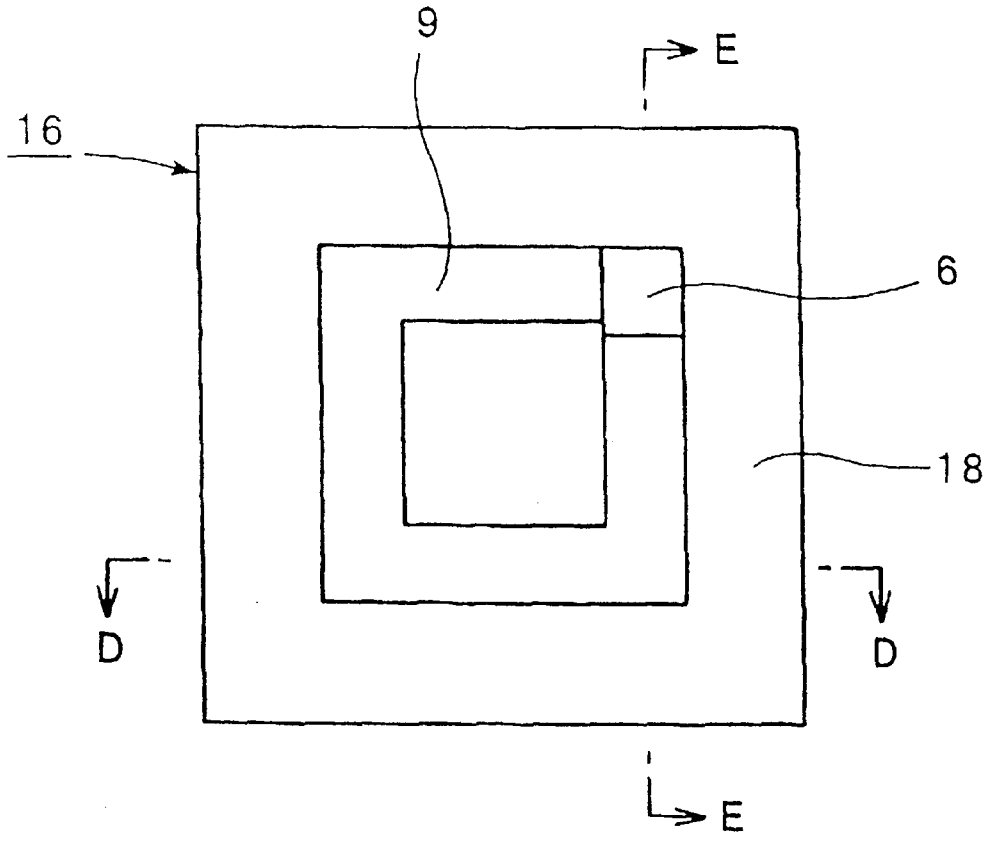
FIG. 4A is a plan view of a second composite sheet.
Figure 4B:
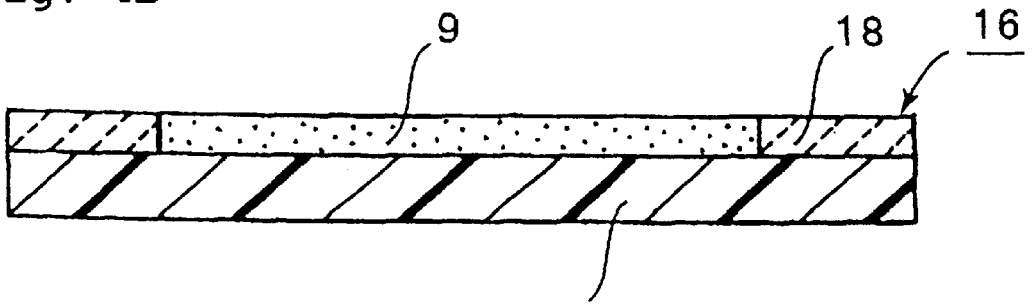
FIG. 4B is a cross-sectional view taken along line D—D of FIG. 4A.
Figure 4C:
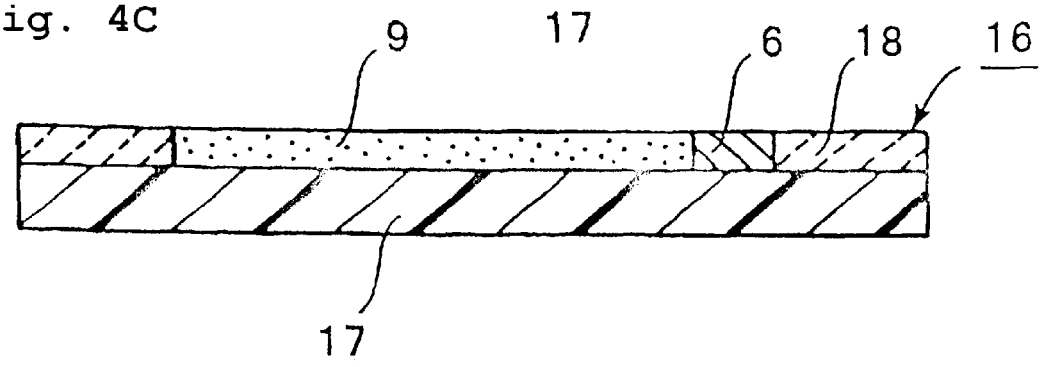
FIG. 4C is a cross-sectional view taken along line E—E of FIG. 4A.
Figure 5:
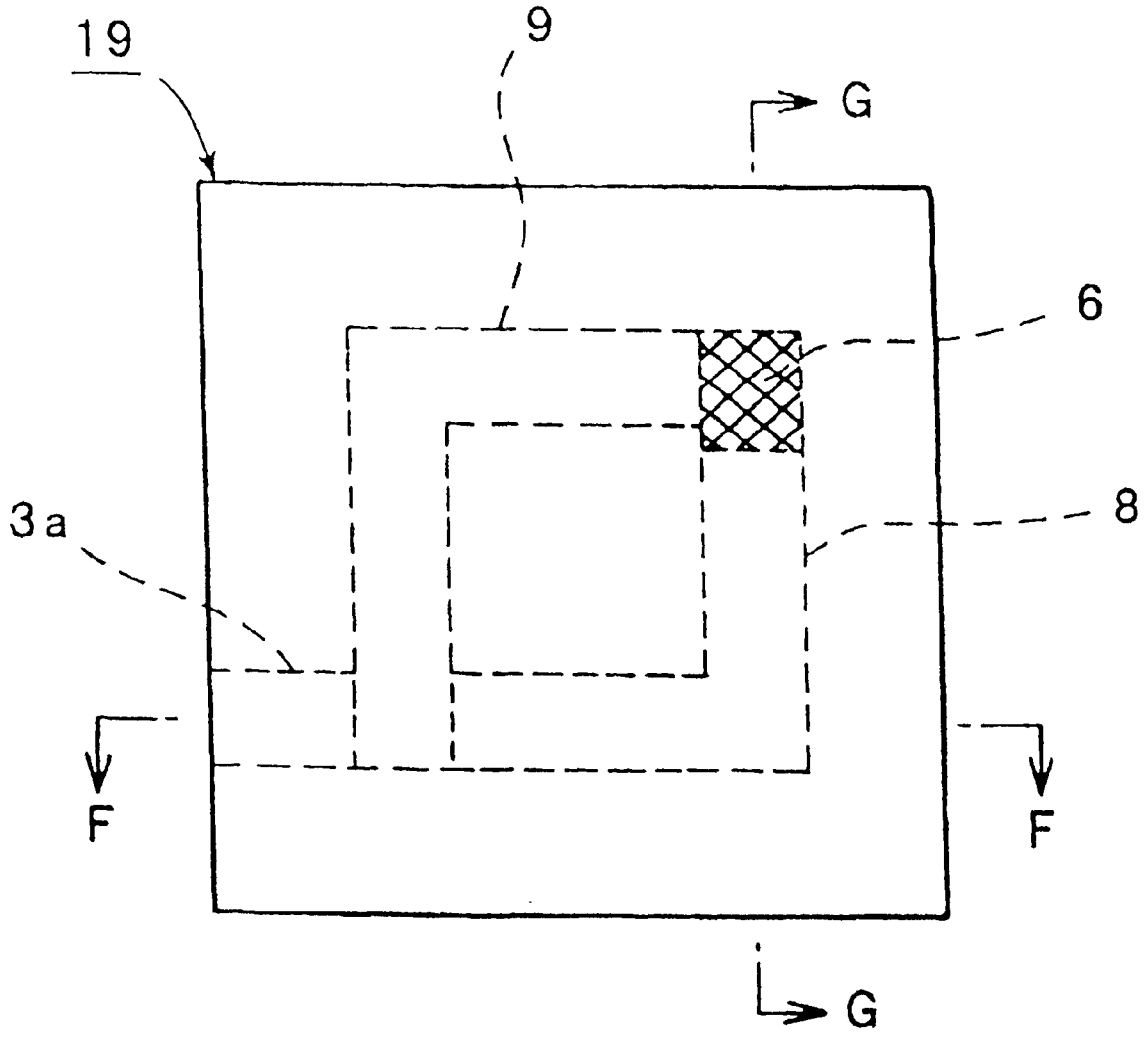
FIG. 5 is a plan view of a laminated sheet prepared in a preferred embodiment of the present application.

Separately from the above-described first composite sheet 13, a second composite sheet 16 shown in FIGS. 4A—4C is prepared. Similarly to the first composite sheet 13, the second composite sheet 16 includes a support film 17 made of an appropriate synthetic resin. A via-hole electrode 6 is formed in the support film 17. In this preferred embodiment, the via-hole electrode 6 has a substantially rectangular shape viewed in the plan thereof, and may have a substantially circular shape or other suitable shape. The via-hole electrode 6 is preferably made of the same electro-conductive material as the conductor pattern 3*a*, and may be made of another conductive material.

A low dielectric constant material layer 9 is arranged so as to be connected to the area where the via-hole electrode 6 is located. The low dielectric constant material layer 9 is arranged to define a substantially rectangular ring-path having substantially the same shape and size as the substantially rectangular winding circuit, that is, the coil conductor 3 viewed in the plan thereof. Thus, the above-described via-hole electrode 6 defines a portion of the ring-path constituted of the low dielectric constant material layer 9. A magnetic green layer 18 is provided on the side of the support film 17 excluding the area where the via-hole electrode 6 and the low dielectric constant material layer 9 are located.

Next, the second composite sheet 16 is stacked onto the first composite sheet 13 from the side of the second composite sheet 16 where the via-hole electrode 6, the low dielectric constant material layer 9 and the magnetic green layer 18 are provided. In this case, the second composite sheet 16 is inverted by about 180° relative to the center of the ring-path and laminated such that the via-hole electrode 6 overlaps the vicinity of the one end portion 3*a* 2 of the conductor pattern 3*a*.

Figure 6A:
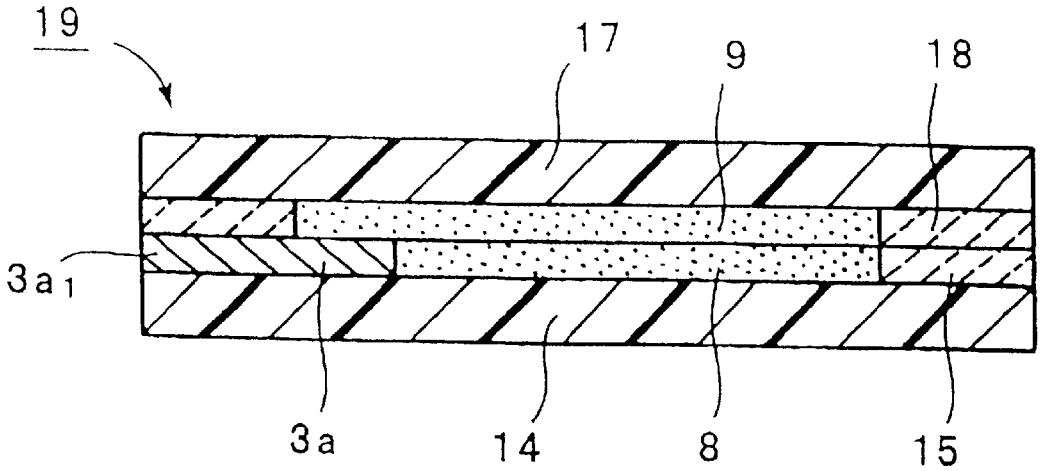
FIGS. 6A and 6B are cross-sectional view s taken along line F—F and line G—G of FIG. 4A, respectively.
Figure 6B:
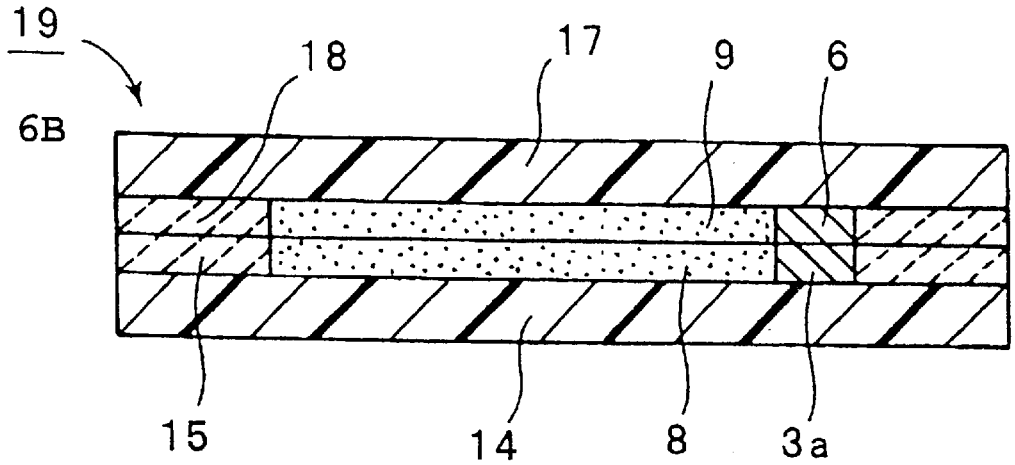

As described above, a laminate sheet 19 shown in FIG. 5 is obtained. In the laminate sheet 19, as seen in FIGS. 6A and 6B which are cross-sectional views taken along the line F—F and the line G—G of FIG. 5, respectively, the via-hole electrode 6 is connected onto the conductor pattern 3*a*. The low dielectric constant material layer 9 is laminated to the one side in the thickness direction of the conductor pattern 3*a*.

In the vertical position where the conductor pattern 3*a* is located, a ring-path corresponding to the substantially rectangular winding circuit is defined by the conductor pattern 3*a* and the low dielectric constant material layer 8. Further, in the vertical position where the via-hole electrode 6 is located, a substantially rectangular ring-path is also defined by the via-hole electrode 6 and the low dielectric constant material layer 9.

Figure 7A:
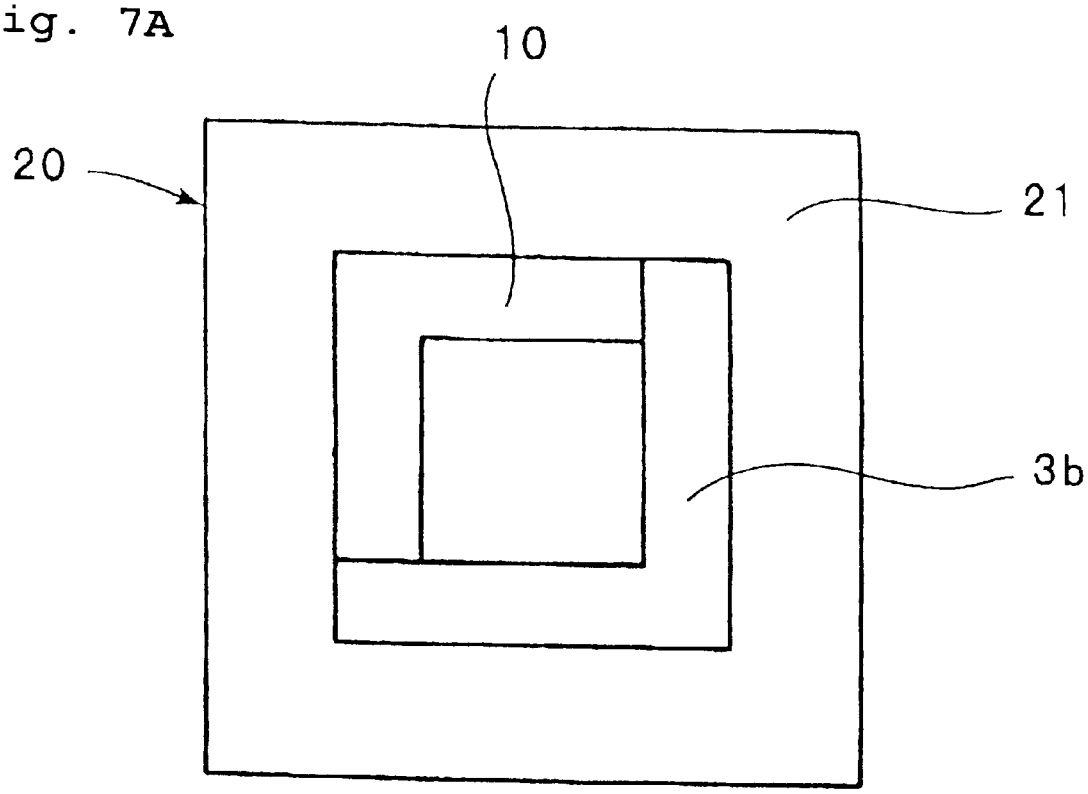
FIGS. 7A and 7B are plan views showing first and second composite sheets, respectively.

Next, another first composite sheet 20 shown in FIG. 7A is prepared. In the composite sheet 20, a conductor pattern 3*b* and a low dielectric constant material layer 10 are arranged on a support film so as to constitute a substantially rectangular ring-path. A magnetic green layer 21 is disposed on the support film excluding the area where the conductor pattern 3*b* and the low dielectric constant material layer 10 are located. The conductor pattern 3*b* is arranged so as to define half of the length of the substantially rectangular ring-path.

The support film 17 positioned on the upper side of the above-described laminated sheet 19 is released. The side of the first composite sheet 20 where the above-described conductor pattern 3*b* is formed is laminated thereto. In this case, the lamination is carried out in such a manner that one end portion of the conductor pattern 3*b* is electrically connected to the via-hole electrode 6.

After that, the support film of the composite sheet 20 is released.

Figure 7B:
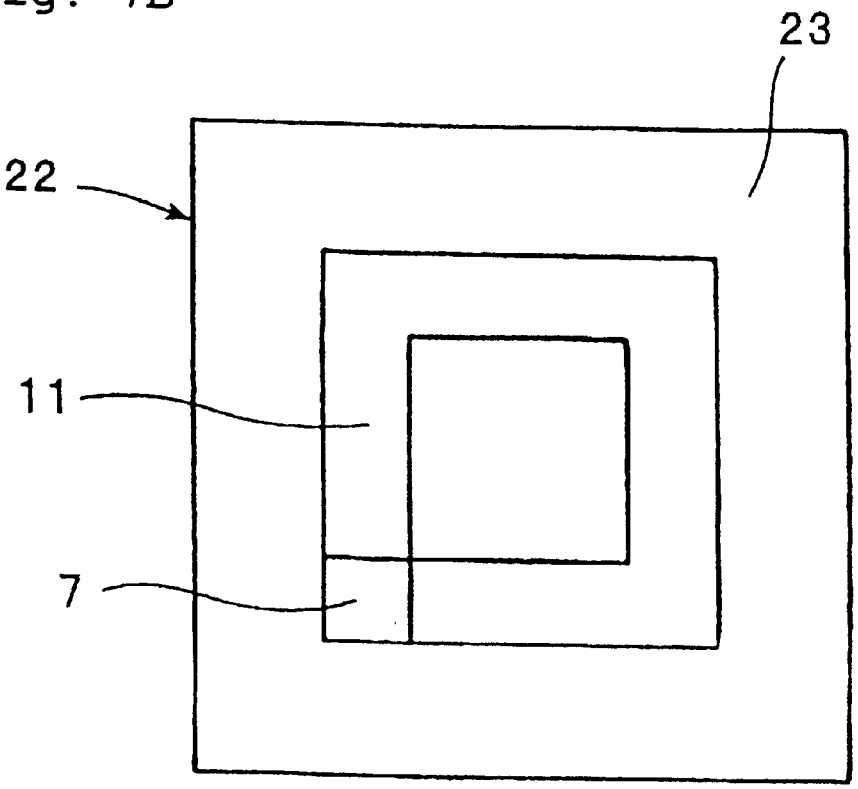
Figure 8:
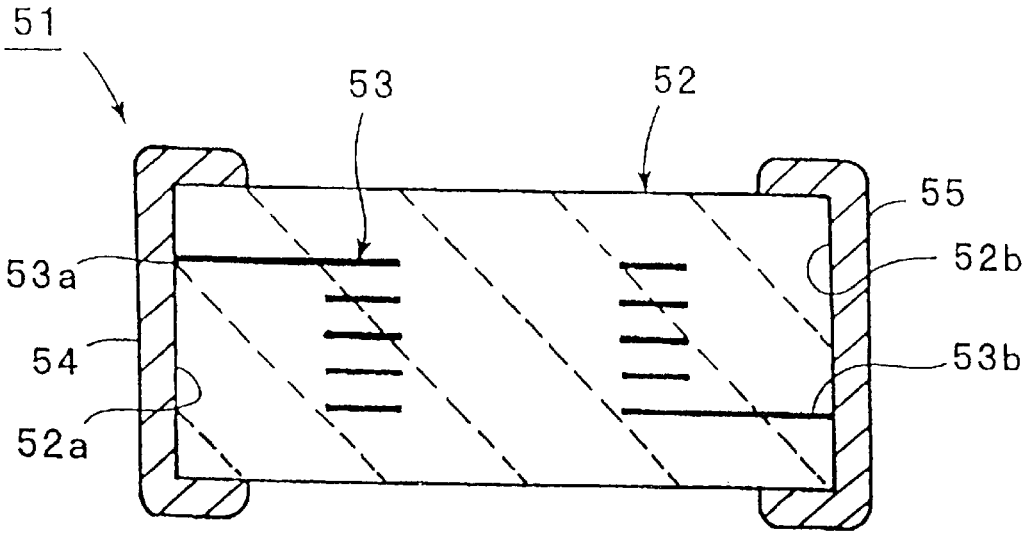
Fig. 8 PRIOR ART
FIG. 8 is a longitudinal cross-sectional view of a conventional laminated inductor.
Figure 9:
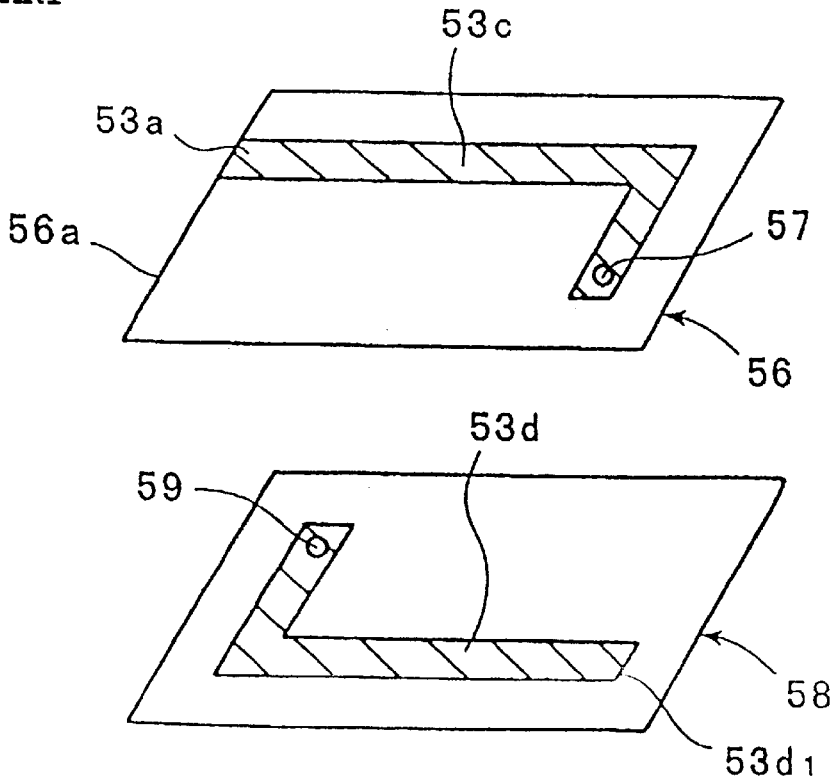
Fig. 9 PRIOR ART
FIG. 9 includes exploded perspective views showing conductor patterns constituting the coil conductor of a conventional laminated inductor.

Further, a second composite sheet 22 shown in FIG. 7B is prepared. In the second composite sheet 22, a substantially rectangular ring-path which is provided on the support film is defined by a via-hole electrode 7 and a low dielectric constant material layer 11. A magnetic green layer 23 is disposed on the support film excluding the area where the substantially rectangular ring-path is located.

The support film of the first composite sheet 20 is released, and the side of the above-described second composite sheet 22 where the via-hole electrode 7 is formed is laminated thereto. In this case, the second composite sheet 22 is laminated in such a manner that the via-hole electrode 7 overlaps and is connected to the other end portion of the conductor pattern 3*b*, and one end portion of the conductor pattern 3*b* is connected to the via-hole electrode 6.

Similarly, though not especially shown, a first composite sheet having a ring-path defined by a conductor pattern 3*c* to constitute the uppermost conductor pattern 3*c* and a low dielectric constant material layer 12 is prepared and laminated in a similar manner. Thus, a laminate having the coil conductor 3 including the conductor patterns 3*a*, 3*b*, and 3*c* connected to each other through the via-hole electrodes 6 and 7 is obtained.

Magnetic green sheets having no patterns are laminated to the upper side and the lower side of the laminate obtained as described above, respectively. The obtained laminate is pressed in the thickness direction thereof, and fired to produce a sintered ceramic body 2.

The external electrodes 4 and 5 are disposed on the end surfaces 2*a* and 2*b* of the sintered ceramic body 2 by the above-described method to produce the laminated inductor 1.

According to the production method of this preferred embodiment, the conductor patterns 3*a*, 3*b*, and 3*c* and the via-hole electrodes 6 and 7 located at the different height ranges and vertical positions of the coil conductor are arranged so as to define ring-paths together with the low dielectric constant material layers 8*a*, 8*b*, 8*c*, and 8*d*, respectively. Accordingly, a low dielectric constant material layer is arranged on at least one side in the thickness direction of each of the conductor patterns 3*a*, 3*b*, and 3*c*. In other words, a low dielectric constant material layer is interposed between conductor patterns in the thickness direction. Therefore, the stray capacitances between the conductor patterns are minimized, and thereby, the noise-removing characteristic is greatly improved.

In the case where the conductor pattern is formed so as to have 1/n times the length of the ring path, an upper first composite sheet is rotated about the center of the ring-path by an angle of about 360/n° with respect to the lower first composite sheet and laminated, so that the upper, lower conductor patterns can be electrically connected to each other through the via-hole electrode securely. Thereby, it is unnecessary to provide a conductor pattern having an extra length.

In the above-described preferred embodiment, each substantially rectangular ring-path includes the conductor pattern and the low dielectric constant material layer. Thus, the coil conductor 3, that is, the substantially rectangular winding circuit viewed in the plan of the coil conductor is formed. In the laminated inductor of various preferred embodiments of the present invention, the plan shape and size of the winding circuit of the coil conductor is not limited to the substantially rectangular shape. The winding circuit may have another shape such as a circle or other suitable shape.

In the laminated inductor of various preferred embodiments of the present invention, a low dielectric constant material layer having a lower dielectric constant than that of the ceramic constituting the sintered ceramic body is interposed between the plurality of conductor patterns which constitute the coil conductor disposed inside of the sintered ceramic body made of the ceramic. The plurality of conductor patterns are located in the different height ranges and at different vertical positions in the sintered ceramic body. Therefore, the stray capacitances between the plurality of conductor patterns are minimized. Accordingly, a laminated inductor having an excellent noise removing characteristic can be provided.

In the laminated inductor of various preferred embodiments of the present invention, preferably, in the height range where a conductor pattern is located, the ring-path corresponding to one turn of the coil conductor is defined by the conductor pattern and the low dielectric constant material layer. In the height range where a via-hole electrode is formed, the ring path corresponding to one turn of the coil conductor is defined by the via-hole electrode and the low dielectric constant material layer. Accordingly, when the conductor patterns at the different height ranges connected to each other through the via-hole electrode, a low dielectric constant material layer is securely interposed between the upper and lower conductor patterns.

According to the method of producing a laminate inductor of various preferred embodiments of the present invention, the above-described first and second composite sheets are laminated to produce a laminated sheet, a plurality of sheets are laminated to produce a laminate in which the via-hole electrodes of upper and lower laminated sheets overlap, and moreover, the conductor patterns of the plurality of laminated sheets define the coil conductor. The produced laminate is fired to obtain the sintered ceramic body, and the first and second external electrodes are then disposed on the sintered ceramic body. Thus, the laminated inductor of various preferred embodiments of the present invention can be easily produced by using the laminated ceramic integral firing technique.

Preferably, the conductor pattern is formed so as to have approximately 1/n times the length of the ring-path. Regarding the lamination of the plurality of first composite sheets through second composite sheets, respectively, an upper first composite sheet is rotated by about 360/n° relative to the center of the ring-path with respect to the lower first composite sheet and then laminated. Thereby, the coil conductor is very simply formed by use of the upper and lower conductor patterns.

Preferably, the first and second composite sheets have a substantially rectangular plan shape, and the conductor patterns each constitute about half the above-described ring-path. In this case, upper and lower conductor patterns can be simply laminated to form the coil conductor by inverting an upper first composite sheet with respect to the lower first composite sheet, in the process of laminating the plurality of first composite sheets through the second composite sheets, respectively.

It should be understood that the foregoing description is only illustrative of the present invention. Various alternatives and modifications can be devised by those skilled in the art without departing from the invention. Accordingly, the present invention is intended to embrace all such alternatives, modifications and variations which fall within the scope of the appended claims.

What is claimed is:

1. A laminated inductor comprising:

a sintered ceramic body made of a ceramic material;

a coil conductor disposed inside of said sintered ceramic body, having two ends extending to opposite outer surfaces of the sintered ceramic body, said coil conductor including a plurality of conductor patterns located at different vertical positions within said sintered ceramic body;

a via-hole electrode located between vertically adjacent ones of the plurality of conductor patterns within said sintered ceramic body and including a hole and a conductive material disposed in said hole through which the vertically adjacent ones of the plurality of conductor patterns are electrically connected to each other;

low dielectric constant material layers laminated to at least one of the plurality of conductor patterns at locations above and below the at least one of the plurality of conductor patterns, respectively, the low dielectric constant material layers having a lower dielectric constant than that of the ceramic material of the sintered ceramic body; and first and second external electrodes located on the areas of the sintered ceramic body to which the ends of the coil conductor extend, respectively.

2. A laminated inductor according to claim 1, wherein at least one of the plurality of conductor patterns and at least one of the low dielectric constant material layers are disposed at a common vertical position within the sintered ceramic body such that a ring-path corresponding to one turn of the coil conductor, is defined by said at least one of the plurality of conductor patterns and said at least one of the low dielectric constant material layers.

3. A laminated inductor according to claim 2, wherein said ring-path has a length, and said conductor pattern is formed so as to have 1/n times the length of the ring-path, where n is an integer.

4. A laminated inductor according to claim 1, wherein at least one of the plurality of conductor patterns and at least one of the low dielectric constant material layers are disposed at a common vertical position within the sintered ceramic body such that a ring-path corresponding to one turn of the coil conductor is defined by the via-hole electrode and said at least one of the low dielectric constant material layers.

5. A laminated inductor according to claim 4, wherein said ring-path has a length, and said conductor pattern is formed so as to have 1/n times the length of the ring-path, where n is an integer.

6. A laminated inductor according to claim 1, wherein the sintered ceramic body has a substantially rectangular plate shape.

7. A laminated inductor according to claim 1, wherein the conductor pattern is made of an electro-conductive paste containing at least one of Ag, Ag—Pd, Cu, and Ni.

8. A laminated inductor according to claim 1, wherein at least one of the low dielectric constant material layers and at least one of the plurality of conductor patterns except for a lead portion thereof, define a substantially rectangular ring-path of said coil conductor.

9. A laminated inductor according to claim 1, wherein the thickness of the low dielectric constant material layer is substantially equal to that of the conductor pattern.

* * * * *